United States Patent [19]

Dokukin et al.

[11] 3,961,558

[45] June 8, 1976

[54] POSITIVE-DISPLACEMENT HYDRAULIC MOTOR

[76] Inventors: Alexandr Viktorovich Dokukin, Zemledelchesky pereulok, 12, kv. 9; Jury Evgenievich Tyablikov, ulitsa Kastanaevskaya, 31, korpus 1, kv. 8, both of Moscow; Anatoly Yakovlevich Rogov, poselok VUGI, 8, kv. 15, Moskovskaya oblast, Ljubertsy-4; Valerian Mikhailovich Berman, Smolenskaya ulitsa, 7, kv. 67, Moscow; Jury Arsentievich Nikitin, ulitsa Vostrukhina, 6, korpus 2, kv. 76, Moscow; Leonid Solomonovich Feifets, ulitsa Udaltsova, 13, kv. 9, Moscow, all of U.S.S.R.

[22] Filed: Nov. 19, 1974

[21] Appl. No.: 525,110

[30] Foreign Application Priority Data

Nov. 20, 1975 U.S.S.R. ..... 1967422

[52] U.S. Cl. ..... 91/35; 91/491

[51] Int. Cl.[2] ..... F01B 13/06; F15B 21/02

[58] Field of Search ..... 91/35, 180, 482, 491, 91/492, 503

[56] References Cited

UNITED STATES PATENTS

| | | | |
|---|---|---|---|
| 3,068,695 | 12/1962 | Cohn et al. | 91/505 |
| 3,084,513 | 4/1963 | Casassa et al. | 91/503 |
| 3,564,976 | 2/1971 | Allen | 91/492 |
| 3,583,283 | 6/1971 | Cunningham | 91/180 |
| 3,603,211 | 9/1971 | Firth | 91/501 |
| 3,661,057 | 5/1972 | Rogov | 91/482 |

*Primary Examiner*—William L. Freeh
*Attorney, Agent, or Firm*—Fleit & Jacobson

[57] ABSTRACT

In a positive-displacement hydraulic motor a valve is mounted so as to be moved positively, individually and continuously during the operation of the hydraulic motor. Spacings between adjacent pairs of valve ports, variable volume chambers and cam portions of the guide element are selected from a predetermined relationships. Such an arrangement makes it possible to predetermine the mode of operation for the hydraulic motor by selecting previously the speed of the movement of the valve.

4 Claims, 11 Drawing Figures

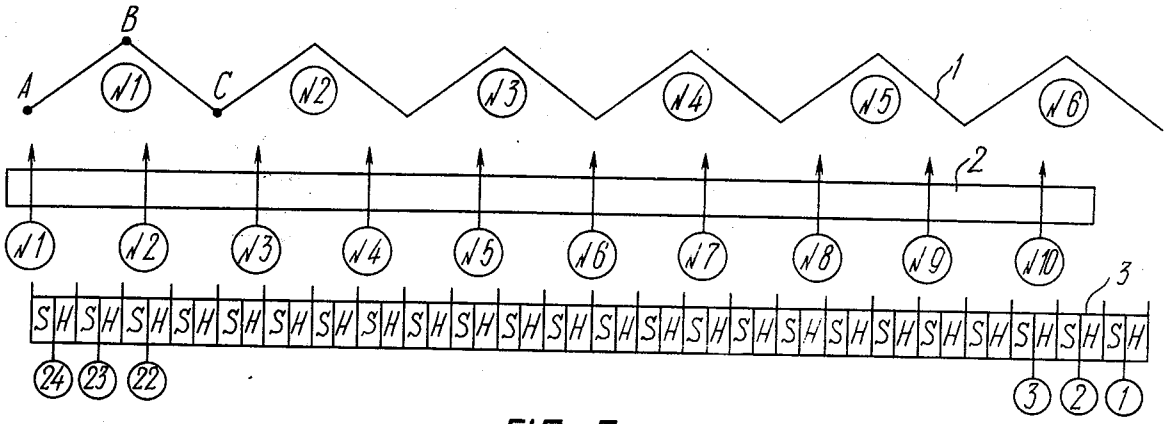
A
B
C
1
2
3
№1
№2
№3
№4
№5
№6
№7
№8
№9
№10
№11
№12
№13
№14
№15
№16
S H S H S H

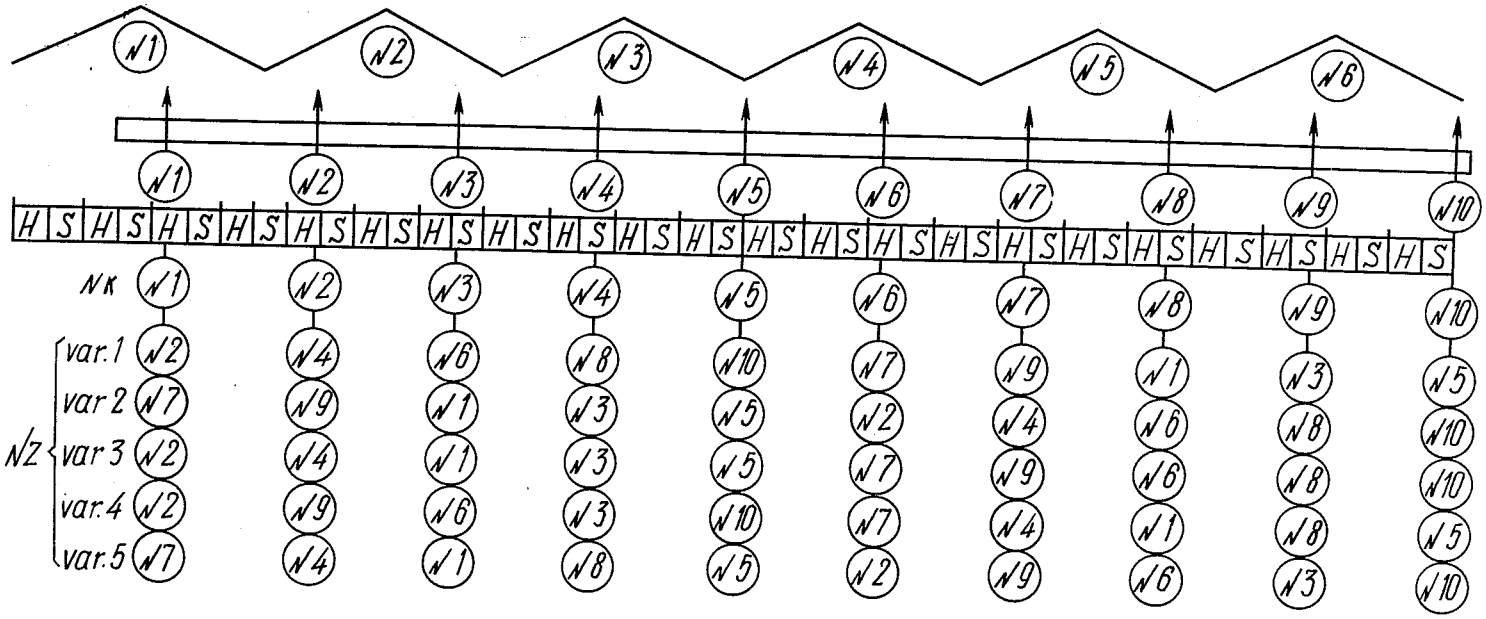
H S H S H S

POSITIVE-DISPLACEMENT HYDRAULIC MOTOR

This invention relates to hydraulic equipment and more particularly to positive-displacement hydraulic motors.

The invention may find use in the metal working industry, metallurgy, transport engineering, ship-building, as well as in other fields of industry requiring applications of motors having high efficiency and low weight-to-power ratios.

Most advantageously this invention can be used in the above-mentioned industries when it is necessary to drive a number of actuating members from a common source of energy, i.e. in group drive circuits such as used in a coal cutter for propelling the machine and driving the cutter head, or in a wheel excavator for the boom and rotor drive, etc.

Known in the art is a positive-displacement hydraulic motor comprising: a guide element; a valve with ports made in the surface thereof, said ports being grouped into pairs so that one port of each pair communicates with a delivery line and the other one communicates with a discharge line; and a block of variable volume chambers, the surface thereof of the having distribution ports facing the valve and each of said chambers is connected by means of a commutating channel to one of said distribution ports and provided with a closer member in permanent engagement with the surface of the guide element which is divided into cam portions so that the closer member performs a complete stroke within the limits of each of said separate cam portions, the spacing between said variable volume chambers being aliquant to the spacing between said cam portions of the guide element.

Different embodiments of the conventional hydraulic motor allow either for individual communication between each of the variable volume chambers and a distribution port of the block, or for communication between one distribution port and a number of chambers simultaneously.

The known hydraulic motor comprises a radial piston-type motor. The guide element is made in the form of a ring-shaped member with the cam portions defined on its inner surface. The variable volume chambers block is arranged coaxially with respect to the guide element. The block is mounted so as to rotate about its own axis and is rigidly connected to an output member, i.e. to a shaft adapted to transmit the torque developed by the motor to the driven member.

The variable volume chambers are defined in the block body by radially extended bores. These bores accommodate pistons comprising the closer members of the variable volume chambers. Rollers are mounted on pivots at the ends of the pistons nearest to the guide element, said rollers providing contact between the piston and the surface of the guide element divided into cam portions.

A concentric bore is made in the central portion of the block with distribution ports provided at the surface of this bore. Each of the variable volume chambers is communicated with one of the distribution ports by means of a commutation channel. A pintle valve is rotatably mounted in the central bore. The ports in the outer surface of this valve communicate with the delivery line and the discharge line so that the ports are grouped into pairs with one port of each pair being connected to the delivery line and the other to the discharge line.

In the conventional hydraulic motor the valve is operatively connected to the guide element. However, to change the operational conditions, the valve may be shifted angularly with respect to the guide element.

In the course of relative movement between the block of variable volume chambers and the valve each port of the block alternatively communicates with the ports of the valve, i.e. distribution of the working fluid is performed due to the interaction between the elements of the block and the valve, this interaction taking place over the surface of the concentric bore. In the text of the specification this surface is defined as the distribution surface.

Upon supplying the working fluid from the delivery line via pressure ports of the valve, the distribution ports of the block and the commutation channels to the variable volume chambers, the pistons, in response to the working fluid pressure, act through the rollers onto the cam portions of the guide element with a force proportional to the pressure of the working fluid and to the piston area. The direction of this force does not coincide with the line normal to the cam at all points on its profile except those on the initial and terminal portions thereof. As a consequence, the normal reaction at a contact point between the roller and the cam profile does not coincide in direction and value, with the force taken up by the piston. The geometrical difference of these two forces comprises a lateral force normal to the axis of the piston and providing the movement of the block of variable volume chambers with respect to the guide element. The sum of products of the lateral force at each contact element by the arm of this force is the torque developed by the hydraulic motor.

At a moment when the variable volume chambers are in communication with the discharge line through the commutation channels, the distribution ports of the unit and the discharge ports of the valve, the working fluid is expelled from the variable volume chambers.

That part of the cam profile of the guide which engages the closer member of the chamber communicated with the delivery line is termed a pressure portion. Over the whole length of the pressure portion of the cam the closer member engaged therewith will be shifted outwardly from the center of the block thereby increasing the volume of each chamber.

Likewise, that part of the cam profile of the guide which engages the closer member of the chamber communicated with the discharge line is termed a discharge portion. Over the whole length of the discharge portion of the cam the associated closer member will be shifted inwardly to the center of the block, thereby decreasing the volume of each chamber.

The pressure and discharge portions of the cam define in combination the complete profile for a cam of the guide element.

The contour of the profile will predetermine the law of movement of closer members, the values of normal and lateral forces acting each of these members as well as the length of their full strokes and, hence, the variations in volume of the variable volume chambers. A number of variable volume chambers and a number of cam portions may be incorporated in the hydraulic motor of the kind referred to. A typical characteristic of the hydraulic motor is its working volume, said volume comprising the product of variation of volume in the variable volume chamber corresponding to the complete stroke of the closer element by the number of these chambers and by the number of those cam portions of the guide element which are in engagement with the closer element of each of said variable volume chambers during one circle, e.g. for one revolution of the block of the variable volume chambers with respect to the guide element. According to the abovesaid, the value of the working volume with regard to one revolution of the block may be determined from the following equation:

$$q = \frac{\pi d^2}{4} \cdot h.Z.x$$

wherein:

d — piston diameter;

h — piston stroke;

z — number of variable volume chambers;

x — number of cam portions of the guide element.

The mean speed W in the course of relative movement of the block of variable volume chambers is proportional to the flow rate Q of the working fluid and is inversely proportional to the working volume "$q$" of the hydraulic motor, i.e.

$$W = \frac{2\pi Q}{q}$$

The average value of torque M developed by the hydraulic motor is proportional to the pressure "$p$" of the working fluid and to the working volume "$q$" of the hydraulic motor, that is $$M = q \cdot p$$

If the valve is positioned with respect to the guide element to ensure a coincidence in time between moments of switching each of variable volume chambers from the delivery line to the discharge one and vice versa and the moments of transferring the closer member of each of the chambers from the pressure portion of the cam to the discharge portion thereof and vice versa, the whole process for increasing the chamber volume is accompanied by communication thereof with the delivery line while the volume decrease period is accompanied by communication of the chamber with the discharge line. In doing so, the maximum possible working volume is ensured for a given hydraulic motor, that is, the maximum possible torque along with the minimum relative speed of the block of variable volume chambers for a given flow rate of the working fluid.

With the valve shifted from the above described position, the process of volume increase in the variable volume chamber is accompanied partially by communicating thereof with the discharge line and, accordingly, the period of decrease in volume of the chamber is accompanied partially by its connection to the delivery line. In this case the closer member of the chamber does not perform any useful work while the variation of the chamber volume is accompanied not by consumption of the working fluid from the delivery line but rather by the circulation thereof through the valve passages. This latter position of the valve is characterized by the value of the working volume less than maximum for a given hydraulic motor, and hence, by a lower operating force and a higher relative speed of movement of the variable volume chambers block.

Angular shifting of the valve with respect to the guide element provides means to control the hydraulic motor by stepless variation of its working volume, i.e. the valve operates as a control element of the hydraulic motor.

In some modifications of hydraulic motors it is possible to have common factors for the number of variable volume chambers and the number of complete cam portions in the guide element. In these cases, closer members of a certain number of variable volume chambers are in permanent engagement with the same points of different portions of the guide element, that is, their movements are strictly coincident in time. This fact provides also time coincidence for volume variations in said chambers, i.e. these chambers are coherent chambers. The number of the coherent chambers is equal to the maximum common factor for the number of variable volume chambers and the number of complete cam portions of the guide element.

The number of chambers with non-coincident time relationship for variations of their volume, that is the number of non-coherent chambers, is equal to a quotient of the total number of chambers divided by the number of the coherent variable volume chambers.

The selection of the number of variable volume chambers and complete cam portions of the guide element is limited by a condition of aliquancy between the number of said portions and the number of the chambers. Since the spacing between the elements is inversely proportional to the number thereof, the above condition may be defined as a condition of aliquancy of the spacing between the variable volume chambers with respect to the spacing between said cam portions of the guide element.

In the conventional hydraulic motor the interconnection between the variable volume chambers and the distribution ports is made so that the numbers assigned to the variable volume chambers in accordance with their arrangement in the block coincide with the numbers assigned to the distribution ports of the block in accordance with their engagement in the distribution surface.

A disadvantage of the conventional hydraulic motor consists in a rigid operative interconnection between the valve and the guide element during the motor operation. This interconnection predetermines a constant working volume of the hydraulic motor for any given operational condition. The amount of this working volume depends on a given position of the distributor with respect to the guide element. This disadvantage leads to the use of complex automatic control circuits for applications of the conventional hydraulic motor in group hydraulic drive systems, said circuits being intended to control operational conditions for each individual hydraulic motor included into the group hydraulic drive system as well as to actuate its adjusting member in case of deviations from the preselected operational conditions.

An object of the present invention is to provide a positive-displacement hydraulic motor wherein adjustment of the speed of valve movements will control operational conditions of the hydraulic motor.

The above and other objects are achieved in a positive-displacement hydraulic motor comprising: a guide element; a valve with ports made in the surface thereof, said ports being grouped into pairs so that one port of each pair communicates with the delivery line and the other one communicates with the discharge line; a block of variable volume chambers, wherein the surface of the block having distribution ports is at the side thereof facing the valve, and each of said chambers is connected by means of a commutation channel to one of said valve ports and provided with a contact member in permanent engagement with the surface of said guide element, which surface is divided into cam portions so that the closer member performs a complete stroke within the limits of each of said separate cam portions, the spacing between said variable volume chambers being aliquant to the spacing between said cam portions of the guide element; by the fact that, according to the invention, the valve is mounted to perform a positive independent, and continuous movement during the operation of the motor, and spacings between the variable volume chambers, cam portions of the guide element and the pairs of ports of the valve respectively are selected from the following relationship:

$$\frac{1}{\theta_r} = \frac{n}{\theta_z} + \frac{k}{\theta_x}$$

wherein:

$\theta_r$, $\theta_z$, $\theta_x$ are spacings between pairs of the ports of the valve, variable volume chambers and cam portions of the guide element;

$n$ and $k$ are factors selected to provide a predetermined ratio between the speeds of the guide element, the block of the variable volume chambers and the valve, the factor $n$ being equal to an integer including null, and the factor $k$ being equal to any integer which is represented by a coprime numbers with respect to the greatest possible number of non-coherent variable volume chambers except for null and a number fulfilling the relationship:

$$K = -n \cdot \frac{\theta_x}{\theta_z} \qquad (2)$$

wherein the factor K correlates the numbers of the variable volume chambers in order of their arrangement in the block with the numbers of the distribution ports in order of their arrangement on the surface facing the valve so that each value of numbers of one of these elements and the product of the number of another element communicating therewith through the commutation channel by factor K represent modulo deductions of the maximum possible number of non-coherent variable volume chambers.

The above-described arrangement of the hydraulic motor ensures the following relationship between relative speeds of the block of variable volume chambers and the valve:

$$\frac{W_{rx}}{W_{zx}} = 1 - \frac{1}{n\,\frac{\theta_x}{\theta_z} + K} \qquad (3)$$

wherein $W$ with doubled symbols is the speed of a hydraulic motor member designated by the first symbol in its movement with respect to the member designated by the second symbol, "$x$" relating to the guide element, "$z$" — to the block of variable volume chambers, "$r$" — to the valve.

A strictly definite ratio between the relative speeds $W_{zx}$ and $W_{rx}$ makes it possible to predetermine the speed of the output member of the hydraulic motor by adjusting the speed of the valve and, therefore, to ensure a constancy of the speed on the output member or its variation irrespective of the applied load within the maximum possible which is achieved respectively by maintaining the valve speed at a constant level or by its variation. The above control provides the selection and maintaining of the selected operational conditions for each hydraulic motor in a group hydraulic drive circuit without the use of complex automatic control circuits.

According to one embodiment of the positive-displacement hydraulic motor the factors $n$ and $K$ comply with the following condition:

$$n = \frac{\theta_x}{\theta_z} + K < 0 \qquad (4)$$

This condition ensures the following relationship between the speeds of the operating members of the hydraulic motor:

$$W_x > W_z > W_r$$

$$W_x < W_z < W_r \text{ and} \qquad (5)$$

According to another embodiment of the positive-displacement hydraulic motor, factors $n$ and $K$ satisfy the following equation:

$$n\,\frac{\theta_x}{\theta_z} + K \geqslant 1 \qquad (6)$$

This equation ensures the following relationship between the speeds of the working members of the hydraulic motor:

$$W_x \geqslant W_r > W_z$$

$$W_x \leqslant W_r < W_z \qquad (7)$$

A further embodiment of the positive-displacement hydraulic motor is characterized by the following relationship between the factors $n$ and $K$ :

$$1 \geqslant n\,\frac{\theta_x}{\theta_z} + K > 0 \qquad (8)$$

with the resulting relationship between the speeds of the hydraulic motor members complying with the following conditions:

$$W_r \leqslant W_x > W_z$$

$$W_r \leqslant W_x < W_z \qquad (9)$$

In the above equations $W_x$, $W_z$ and $W_r$ are respectively speeds of the guide element, the unit of the variable volume chambers and the valve during their movement.

Thus, the positive-displacement hydraulic motor according to the invention makes it possible to preselect the speed and to maintain the peselected speed of the output member by adjusting the speed of the valve, different embodiments of the invention providing any required relationship between the associated speeds.

The invention will now be described in greater detail with reference to embodiments thereof which are represented in the accompanying drawings, wherein:

FIG. 8 is the same as shown in FIG. 6;

FIG. 9 is the same as shown in FIG. 6;

FIG. 10 is the same as shown in FIG. 6;

A hydraulic motor may be of any kind with rotary, translatory, reciprocatory motion etc. of its operating members. Given below are some examples illustrating these possibilities.

Figure 2:
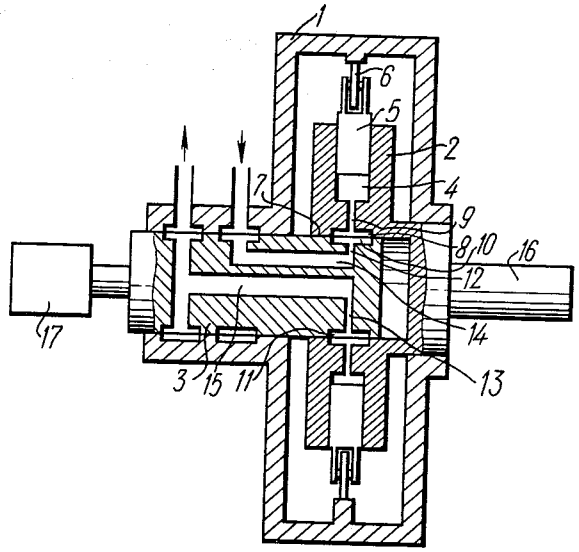
FIG. 2 is a longitudinal sectional view of the hydraulic motor shown in FIG. 1.
Figure 1:
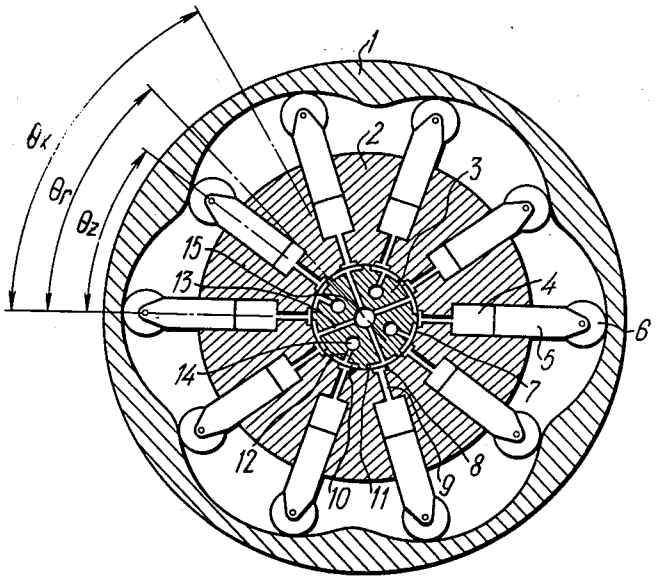
FIG. 1 is a diagramatical cross-sectional view of a positive-displacement hydraulic motor made in accordance with the present invention.

Referring to FIG. 1 and FIG. 2, there is shown a hydraulic motor with rotary motion of the valve and the block of variable volume chambers.

The hydraulic motor is provided with a guide element 1 (FIG. 1), a block 2 of variable volume chambers and a valve 3. The guide element 1 comprises a ring having cam portions on its inner surface, with spacings $\theta_x$ between adjacent cam portions. Radially extending bores are made in the block 2, said bores defining chambers 4 of variable volume. Each chamber 4 accommodates a piston 5 serving as a closer member for the appropriate variable volume chamber 4. The ends of the pistons 5 facing the guide element 1 are equipped with rollers 6 which provide means for engagement between the pistons 5 and the surface of the guide element 1 divided into cam portions. The rollers may rotate freely on their axes. The variable volume chambers 4 have spacings $\theta_z$ between adjacent chambers.

A concentric bore 7 is formed in the block 2, the surface of this bore being a distribution surface. This surface is provided with distribution ports 8 connected to the chambers 4 through commutation channels 9.

The valve 3 is mounted angularly movable in the bore of the block 2. There are delivery and discharge ports in the surface of the valve and radially extended passages 12, 13 in the body thereof, said passages terminating in axial passages 14 and 15 respectively. The channels 12 and channels 14 communicate the delivery ports 10 with the delivery line. The passages 13 and channels 15 communicate the ports 11 with the discharge line. Ports 10 and 11 of the valve are grouped in pairs each having one delivery port 10 and one discharge port 11. The spacing between adjacent pairs of the ports is equal to $\theta_r$.

The block 2 is mechanically interconnected with an output shaft 16. The guide element 1 is mounted stationary. The valve 3 is connected to an individual drive unit 17.

Figure 3:
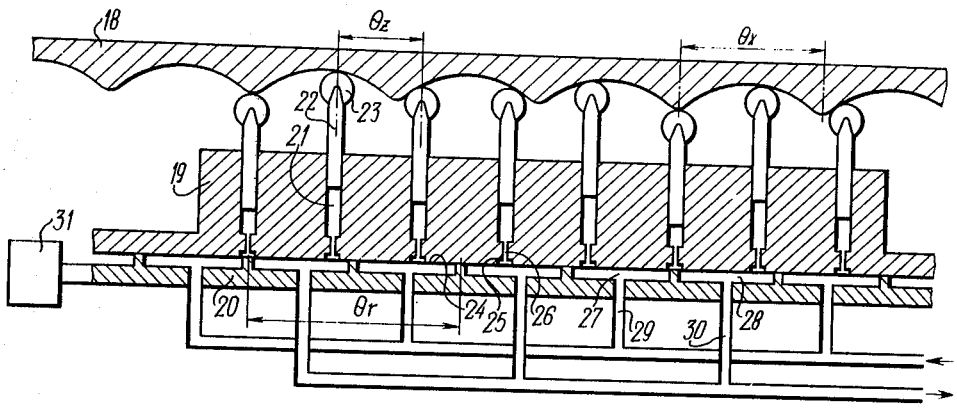
FIG. 3 illustrates one embodiment of the positive-displacement hydraulic motor according to the invention.

An embodiment of the hydraulic motor with translatory movements of all its operating members is shown in FIG. 3. The motor comprises a guide element 18, a block 19 of variable volume chambers and a valve 20.

The guide element comprises a flat portion, the surface of this portion facing the unit 19 is provided with cam portions with spacings between adjacent cam portions being equal to $\theta_x$.

Variable volume chambers 21 are defined in the block 19 by means of bores accommodating pistons 22 serving as closer members for these chambers 21. Rollers 23 are mounted for free rotation on pivots at the ends of the pistons. These rollers 23 provide means for engagement between the pistons 22 and the surface of the guide element 18. The spacing between adjacent chambers is equal to $\theta_z$.

The surface 24 of the block 19 facing the valve 20 is provided with distribution ports 25 communicating with the chambers 21 through commutating channels 26.

The surface of the valve 20 facing the surface 24 of the block 19 is provided with delivery ports 27 and discharge ports 28. The delivery ports 27 communicate with the delivery line via channels 29, while the ports 28 are connected to the discharge line via channels 30. The ports 27 and 28 of the valve are grouped into pairs, each having one delivery port 27 and one discharge port 28. The spacing between two adjacent pairs of the ports is equal to $\theta_r$.

The guide 18 is connected to an output member (not shown in the drawing) of the hydraulic motor. The block 19 is stationary. The valve is equipped with an individual drive unit 31.

Figure 4:
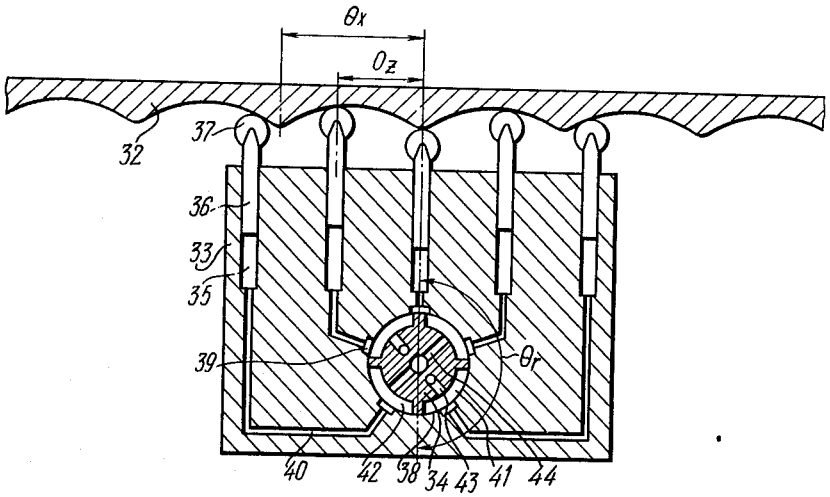
FIG. 4 is another embodiment of the hydraulic motor according to the invention.

FIG. 4 illustrates an embodiment of the hydraulic motor wherein a guide element has a translatory motion, the block is stationary and the valve is rotatable. The hydraulic motor comprises a guide element 32, a block 33 of variable volume chambers and a valve 34.

Cam portions with spacing $\theta_x$ are made on the guide element 32 at the side thereof facing the block 33.

Bores defining variable volume chambers 35 are formed in the unit 33. These bores accommodate pistons 36 serving as closer elements for the variable volume chambers 35. The pistons 36 are provided with rollers 37 mounted with free rotation about their pivots. The pistons 36 engage the surface of the guide element 32 through said rollers 37.

The spacing between two adjacent variable volume chambers is equal to $\theta_z$.

A bore is defined in the unit 33, the surface 38 of which is a distribution surface. The distribution surface is provided with distribution ports 39 communicated with the chambers 35 through commutation channels 40. The valve 34 is mounted angularly movable in the bore of the block 33. Delivery ports 41 and discharge ports 42 are made in the surface of the valve. The delivery ports 41 are connected to the delivery line via channels 43 while the discharge ports 42 communicate with the discharge line through channels 44. The ports 41 and 42 of the valve 43 are grouped into pairs whith each pair having one delivery port 41 and one discharge port 42. The spacing between two adjacent pairs is equal to $\theta_r$.

The guide element 32 is connected to an output member (not shown) of the hydraulic motor. The valve 34 is connected to an individual drive means (not shown).

The mode of operation of the hydraulic motor will now be explained with reference to FIG. 1 and FIG. 2. The operation of hydraulic motors made in accordance with other embodiments shown in the rest of the drawings are substantially the same.

A supply of the working fluid to the hydraulic motor is initiated simultaneously with the actuation of the drive means 17 for the valve 3.

With the supply of the working liquid from the delivery line via the passages 12 and channels 14, the delivery ports 10 of the valve 3, the distribution ports 8 and commutation channels 9 to the variable volume chambers 4, a pressure of the working fluid will be applied to the pistons, which pistons will act against the cam portions of the guide element 1 through the rollers 6. The directions of forces acting onto pistons do not coincide wih the line normal to the profile of the guide element 1. Therefore, the normal reaction at a contact point between the rollers and the cam portion of the guide element 1 is different with respect to the value and direction from those of the force applied to the piston 5.

The geometrical difference of these two forces comprises the lateral force ensuring the movement of the block 2 of the variable volume chambers with respect to the guide element 1.

Figure 5:
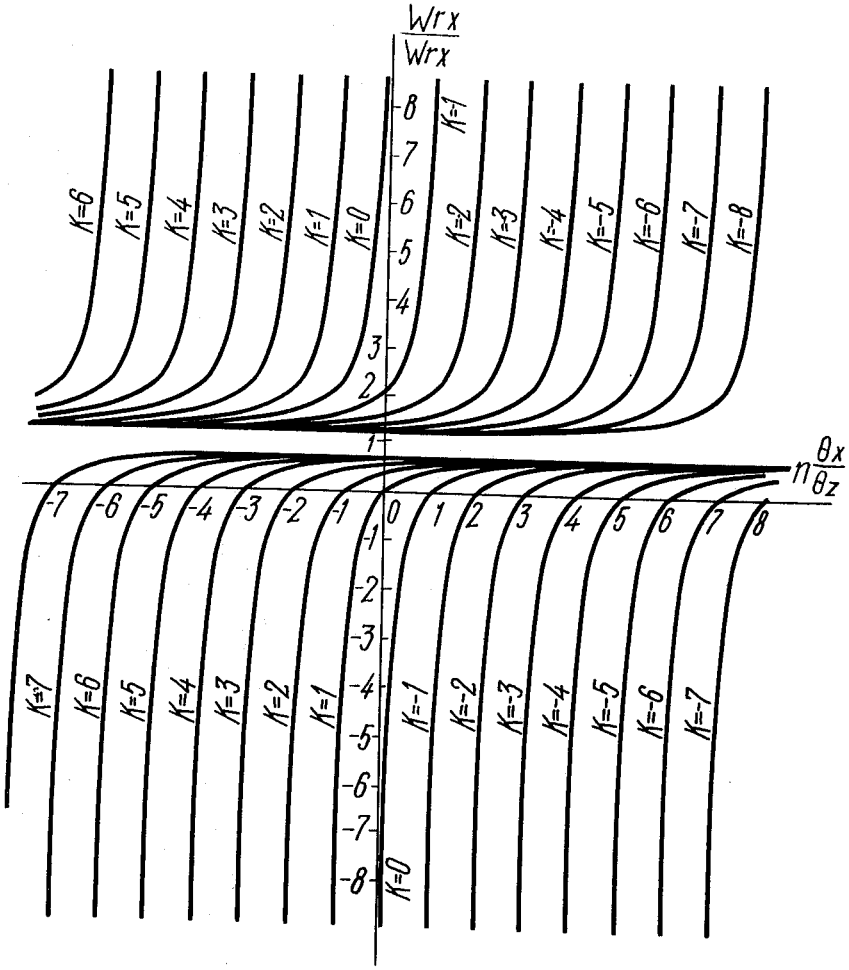
FIG. 5 is characteristics of the positive-displacement hydraulic motor according to the invention.

The speed $W_{zx}$ of this relative movement is related to the speed $W_{rx}$ of the movement of the valve 3 with respect to the guide element 1 according to the equation (3) incorporating the values $\theta_x$ and $\theta_z$ as well as the factors $n$ and $K$. An appropriate selection of values for these four parameters or for two of them ($n$ and $K$) with preselected values of $\theta_x$ and $\theta_z$ makes it possible to obtain any required speed ratio $W_{rx}/W_{zx}$. The aforesaid is illustrated by a diagram shown in FIG. 5. This diagram may be used for choosing the required values of the parameters.

The interaction between the hydraulic motor members is considered for several combinations of the parameters $\theta_x$, $\theta_z$, $n$ and $K$. It is shown that with the spacing $\theta_r$ between adjacent pairs of ports of the valve 3 according to the equation (1) and with the movement of the hydraulic motor members with speeds according to the condition of the equation (3), it is possible to ensure the interaction between said members in much the same way as it has been described with reference to the known hydraulic motor.

In FIGS. 6–11 wherein developments of the hydraulic motor members (the guide element 1, the block 2 of the variable volume chambers and the valve 3) are shown diagramatically, the cam portions on the surface of the guide element 1 are illustrated conventionally as straight line portions. Figures in circles identify serial numbers of these portions, of variable volume chambers 4 and those of the pairs of ports of the distributor 3. The ports of the valve 3 with the symbol "*h*" attached thereto are connected to the delivery line while those ports which are identified by the symbol "*s*" are connected to the discharge line. For the subsequent text of the description it will be assumed that the ports of the valve 3 have zero overlapping and that the delivery line and the discharge line are of equal extension.

Figure 6:
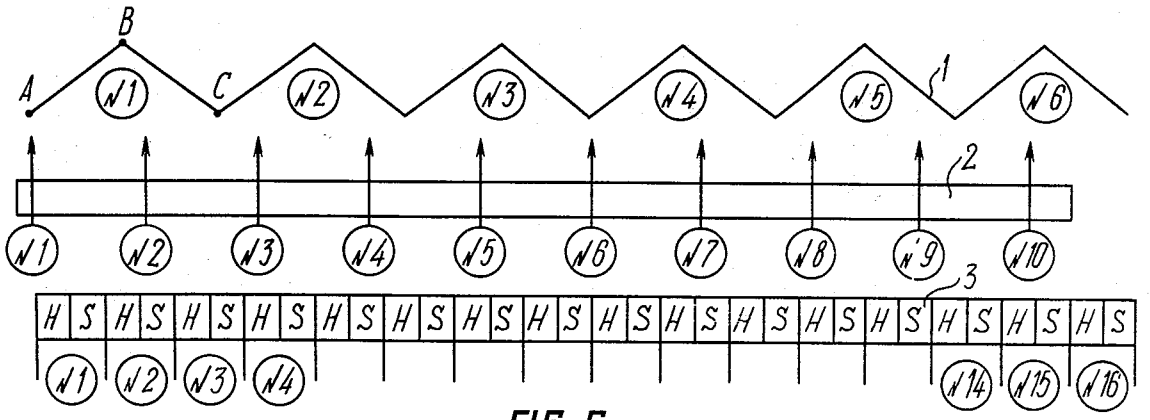
FIG. 6 is a diagramatical developed view of elements of the hydraulic motor.

Referring to FIG. 6, there is shown a development of hydraulic motor members for $n = 1$ and $K = 1$. It has been assumed that $\theta_x = \pi/3$, $\theta_z = \pi/5$ and the value of $\theta_r = \pi/8$ has been determined from the equation (1). According to the relationship (3) the speed ratio is characterized by the following value:

$$\frac{W_{rx}}{W_{zx}} = 1 - \frac{1}{1 \cdot \frac{\pi \cdot 5}{3 \cdot \pi} + 1} = \frac{5}{8}$$

The length of the delivery as well as the discharge portions of the guide element 1 is equal to half of the spacing $\theta_x$, i.e. to $\pi/6$. Thus, the length of the discharge port and that of the delivery one is equal to half of the spacing $\theta_r$, i.e. to $\pi/16$.

In the course of movement of the guide element 1 from the left to the right the chamber marked as No. 1 will pass the whole delivery portion from point A to point B during a time period equal to $\pi/6\ W_{zx}$. During the same time the angular shift of the valve 3 driven from the individual drive means 17 in the course of its movement relative to the guide element 1 will be equal to $$W_{rx} \frac{\pi}{6 \cdot W_{zx}} = \frac{5\pi}{48},$$

this value being equal to the angular distance between the end of the delivery port in the first pair of ports of the distributor 3 and the end of the delivery portion on the cam profile No. 1. In fact, this distance is equal to $$\frac{\theta_x}{2} - \frac{\theta_z}{2} = \frac{\pi}{6} - \frac{\pi}{16} = \frac{5\pi}{48}$$

Thus, the transfer of the chamber No. 1 from the delivery portion to the discharge portion of the cam profile is coincident in time with the switching of this chamber from the delivery line to the discharge line.

Further, the chamber No. 1 will be shifted through an angle equal to the angular extension of the discharge portion from point B to point C for the same period $\pi/6$ $W_{zx}$. During the same time the valve 3 is shifted through an angle $5\ \pi/48$, i.e. the transfer of the chamber No. 1 from the discharge portion of the cam profile No. 1 to the delivery portion of the cam profile No. 2 is coincident in time with the switching of this chamber from the discharge port of the pair No. 1 of valve ports to the delivery port of the pair No. 2.

In the same way, one can follow the mode of interaction between the chamber No. 1, other cam portions of the guide element 1 and other pairs of ports of the valve 3 discovering that the periods of time for communication between any selected chamber 4 of variable volume and the pair of ports of the valve 3 are equal to periods of contact between the contact member 5 of this chamber 4 and the full length of a cam portion of the guide element 1.

Figure 7:
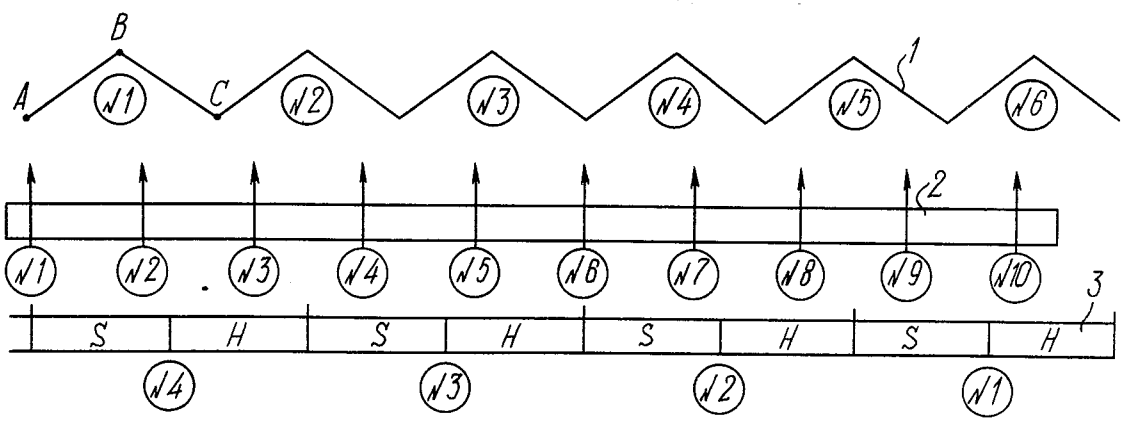
FIG. 7 is the same as shown in FIG. 6.

A development of the hydraulic motor members is shown in FIG. 7 for an embodiment which differs from the described above the value of the factor $n$. It is assumed that this factor $n$ is equal to $-1$, ($n = -1$). The values of $K = 1$, $\theta_x = \pi/3$ and $\theta_z = \pi/5$ are left unchanged. According to the equation (1), $\theta_r = -\pi/2$. The sign "–" (minus) means that the pairs of ports of the distributor 3 are directed opposite to that for arrangement of the variable volume chambers, this fact being taken into account in designation of pairs of ports by appropriate symbols.

Similarly to the previous embodiment of the invention, the speed ratio will be as follows:

$$\frac{W_{r.x}}{W_{z.x}} = 1 - \frac{1}{1 \cdot \frac{\pi}{3} \cdot \frac{5}{\pi} + 1} = \frac{5}{2}$$

As in the previous embodiment, the extension of the delivery portion and the discharge portion of the cam profile is equal to $\pi/6$. At the same time, for this case the length of one port of the valve 3 is equal to $\pi/4$.

In the course of its movement from the left to the right relative to the guide element 1, the chamber 4 identified by No. 1 will pass a length equal to that of the delivery portion from point A to point B for time equal to $\pi/6\ W_{z.x}$. The same time an angular shift of the valve 3 with respect to the guide element 1 will be $$W_{r.x} \quad \frac{\pi}{t\,6 \cdot W_{z.x}} = = 5\ \pi\ /12$$

which is equal to the angular distance between the end of the delivery port of the first pair of the valve ports and the end of the delivery portion of the cam profile No. 1. As the cam portions and valve ports are inversely numbered relative to each other, said distance is equal to the arithmetic sum of extensions ($\pi/6$) and ($\pi/4$) corresponding to the delivery portion of the cam profile and the delivery port of the valve respectively. However, this distance cannot be determined, as in the previous case, by an algebraic difference of these values. In fact, it may be written as follows:

$$\frac{\theta_x}{2} - \frac{\theta_z}{2} = \frac{\pi}{6} - \left(-\frac{\pi}{4}\right) = \frac{5\pi}{12}$$

Thus, the transfer of the chamber No. 1 from the delivery to the discharge portion of the cam portion is coincident in time with the switching of this chamber from the delivery line to the discharge one.

Much in the same way, one can determine that the transfer of the chamber No. 1 from the discharge to the delivery portion of the cam profile at point C is coincident in time with the switching of this chamber from the discharge line to the delivery one. In the same manner one may follow the interaction of the chamber No. 1 with other cam portions of the guide element 1 and with other pairs of ports of the valve 3. In doing so, on can reveal the time coincidence for communication of any selected variable volume chamber 4 with a pair of distributor ports and engagement between the contact member of this chamber 4 with the whole length of the cam portion of the guide element 1.

Referring now to FIG. 8, there is shown a development of the hydraulic motor members for an embodiment of the invention with the following parameters: $n = -1$, $K = 1$, $\theta_x = 2\ \pi/11$, $\theta_z = \pi/3$.

In this case, according to the relationship (1), $\theta_r$ is equal to $2\ \pi/5$, while the speed ratio comprises $W_{r.x} = -6/5$ Such values indicate that the block 2 $W_{z.x}$ of variable volume chambers and the valve 3 in the course of their movement with respect to the guide element 1 rotate in opposite directions (sign −).

The length of the delivery portion of the cam profile on the guide element 1 as well as that of the discharge portion thereof comprises $\pi/11$, while the length of each port of the valve 3 is equal to $\pi/5$.

During its movement from the left to the right relative to the guide element 1, the chamber identified by No. 1 will pass an angular length equal to the length of the delivery portion of the cam profile from point 1 to point B for the period equal to $\pi/W_{z.x}.11$. During the same time, the angular shift of the valve 3 with respect to the guide 1 will comprise $$W_{z.x} \quad \frac{\pi}{11 \cdot W_{z.x}} = -\ 6\ \pi\ /55$$

which, as in the previous case, is equal to the algebraic difference between the extension of delivery portion of the cam profile on the guide element 1 and that of the delivery port of the valve 3. In fact, it may be written as follows:

$$\frac{\theta_x}{2} - \frac{\theta_z}{2} = \frac{\pi}{11} - \frac{\pi}{5} = -\frac{6\pi}{55}$$

The sign − indicates the direction of the movement, since it has been assumed that the positive one is a clockwise direction (the direction from the left to the right in developed views).

Comparing angular distances travelled for the same period of time by the block 2 of the variable volume chambers and by the valve, one can determine a coincidence in time for the transfer of the chamber No. 1 from the delivery to the discharge portion of the first cam profile on the guide element 1 and from the delivery to the discharge port of the first pair of ports of the valve 3. In the course of its further movement with respect to the guide element 1 the chamber No. 1 will pass from point B to point C (the discharge portion of the profile) during the time period equal to $\pi/11.\ W_{z.x}$. During the same time the valve will pass in its movement with respect to the guide element an angular distance equal to $$W_{z.x} \quad \frac{\pi}{11 \cdot W_{z.x}} = 6\ \pi\ /55.$$

Thus, the transfer of the chamber No. 1 from the discharge portion of the first cam profile to the delivery portion of the second cam profile is coincident in time with the switching of this chamber from the discharge port of the first pair to the delivery port of the second pair of ports.

Having thus established the manner of interaction between the chamber No. 1 and other cam portions of the guide element and ports of the valve as well as the manner of interaction between cam portions and ports of the valve 3 and other chambers, one can determine the coincidence in time for periods of communication of any selected variable volume chamber 4 with each of said pairs of valve ports and for periods of engagement between a closer member of this chamber and each complete cam portion of the guide element 1.

Referring to FIG. 9, there is shown a development of the hydraulic motor members for an embodiment of the invention with the following parameters: $n = -3$, $K$ 9= 1, $\theta_x = \pi/3$ and $\theta_z = \pi/5$.

According to the equations (1) and (3), the following values of $\theta_r$ and of speed ratio correspond to these parameters: $\theta_r = -\pi/12$ and $W_{r.x}/W_{z.x} = 5/4$. The length of the delivery portion and that of the discharge one on the cam profile of the guide element comprise respectively 1 and $\pi/6$, while the length of the delivery and discharge ports of the valve 3 comprises $\pi/24$.

A negative value for the spacing $\theta_r = -\pi/12$ between pairs of ports of the valve 3 means that the pairs of ports are arranged in the direction opposite to that for the arrangement of the variable volume chambers 4. This fact was taken into account in designations of pairs of ports by the assigned numerical symbols.

In the course of its movement from the left to the right with respect to the guide element 1, the chamber 4 identified by No. 1 will pass a distance equal to the extension of the delivery portion from point A to point B during the period of time equal to $\pi/6\ W_{zx}$. During the same time, the angular shift of the valve 3 with respect to the guide element 1 will comprise $$W_{zx}\ \frac{\pi}{6 \cdot W_{zx}} = \frac{5\pi}{24}$$

which is equal to the distance between the end of the delivery port in the first pair of ports of the valve 3 and the end of the delivery portion on the first cam profile of the guide element 1, said distance, as in the previous cases, being determined by the algebraic difference between extensions of these elements. In fact, it may be written:

$$\frac{\theta_x}{2} - \frac{\theta_z}{2} = \frac{\pi}{6} - \left(-\frac{\pi}{24}\right) = \frac{5\pi}{24}$$

Thus, the transfer of the chamber No. 1 from the delivery portion to the discharge portion of the cam profile will be coincident in time with the period for switching this chamber 4 from the delivery line to the discharge one.

In the course of its further movement with respect to the guide element 1, the chamber No. 1 will pass the distance from point B to point C (the discharge portion of the cam profile) during the time equal to $\pi/6\ W_{zx}$. During the same time the valve 3 will pass, during its movement with respect to the guide element, an angular distance equal to $$W_{zx}\ \frac{\pi}{6 \cdot W_{zx}} = 5\ \pi/24.$$

Thus, the transfer of the chamber No. 1 from the discharge portion of the first profile to the delivery portion of the second cam portion will be coincident in time with the switching of this chamber from the discharge port in the first pair of ports to the delivery port of the second pair.

Upon interaction between the chamber No. 1 and other cam portions of the guide element 1 and ports of the valve 3 as well as during the operation of other chambers, time coincidence will take place between the period of communication of any selected variable volume chamber with each of said pairs of valve ports and the periods for engagement between the closer member 5 of this chamber 4 and each complete cam profile of the guide element 1.

Referring now to the FIG. 10, a development of the hydraulic motor members is shown for an embodiment with the following parameters: $n = 1$, $K = 2$, $\theta_x = \pi/3$, $\theta_z = \pi/5$.

From the equations (1) and (3) one can find that $\theta_r = \pi/11$ and $W_{rx}/W_{zx} = 8/11$.

The fact that $K$ is not equal to 1 indicates that positions of distribution ports in the distribution surface do not coincide with those of the associated variable volume chambers communicating therewith, though geometrically the variable volume chambers 4 may have the same arrangement with respect to the valve 3 as the distribution ports.

It may be seen from FIG. 10 that the variable volume chambers (having the same numerical designations as in FIGS. 6–9) and the distribution ports (with their numbers $N_k$ indicated in circles below the valve 3) have the same arrangement with respect to the valve 3. Numbers $N_z$ for the variable volume chambers 4 communicated with the distribution ports 8 via commutation channels 9 are indicated in circles below the numbers $N_k$. Five rows of numbers $N_z$ correspond to five versions for commutation. However, all these versions are characterized by one common feature consisting in that, according to the invention, a product of number $N_k$, in this case that of the valve port, by the factor K and number $N_z$ of the variable volume chamber communicated thereto are modulo residues (i.e. they give equal remainders for their division by the same value called as module) of the number of non-coherent variable volume chambers.

In a particular version under consideration hydraulic motor members are spaced circumferentially in a following manner:

cam portions of the guide 1 in a number of $$\frac{2\pi}{\pi/3} = 6$$

with the spacing $\pi/3$ ;

Variable volume chambers 4 in a number of $$\frac{2\pi}{\pi/5} = 10$$

with the spacing $\pi/5$;

pairs of ports of the valve 3 in a number of $$\frac{2\pi}{\pi/11} = 22$$

with the spacing $\pi/11$.

Let us check for compliance with the rule of commutation. As the number (6) of the cam portions and the number (10) of the variable volume chambers 4 has a common factor 2, the number of coherent chambers 4 is equal to 2. Actually, it may be seen from the development (FIG. 10) that all the chambers in pairs are in the same phases of a work circle. Therefore, the number of non-coherent variable volume chambers will be 10/2=5.

According to the invention, the maximum possible number of non-coherent variable volume chambers 4 should be selected when forming the circuits of commutation. In case when the positive-displacement motor is made in the form of a radial piston hydraulic motor the number of non-coherent chambers 4 determined as a quotient obtained from the division of the total number of variable volume chambers by that of the coherent chambers coincides with the maximum possible number of non-coherent chambers. In embodiments of the positive-displacement motors with translatory motion, as shown in FIG. 3, the actual number of chambers 4 should be conventionally increased up to that equal to the number of coherent chambers 4 in each given phase with the subsequent division of the resultant number by the number of coherent chambers, thereby obtaining the maximum possible number for variable volume chambers 4. This number may be determined by mere calculation on the development of those chambers 4 which do not coincide by phase.

Having thus established for the particular considered case the number (5) of the non-coherent variable volume chambers 4, one can check for compliance with the rule of commutation.

For the version No. 1 (the upper row of numbers $N_z$ in FIG. 10) the following pairs of numbers are modulo 5 residues 1×2 and 2, 2×2 and 4, 3×2 and 6, 4×2 and 8, 5×2 and 10, 6×2 and 7, 7×2 and 9, 8×2 and 1, 9×2 and 3, 10×2 and 5.

For the version 4 the following pairs of numbers are modulo 5 residues: 1×2 and 2, 2×2 and 9, 3×2 and 6, 4×2 and 3, 5×2 and 10, 6×2 and 7, 7×2 and 4, 8×2 and 1, 9×2 and 8, 10×2 and 5.

The same results will be obtained when checking other versions of commutation shown in FIG. 10.

For commutation according to version No. 1 the chamber No. 6 is communicated with the distribution port No. 3. The chamber No. 6 is located in the region of the discharge portion No. 4 of the cam profile. The angular distance which should be passed by this chamber to the end of said portion with respect to the guide element 1 is equal to the difference of spacings between adjacent cam profiles and adjacent variable volume chambers 4 respectively, i.e.

$$\theta_r - \theta_z = \pi/3 - \pi/5 = \frac{2\pi}{15}$$

and will be travelled for the period of time equal to $2\pi/15 \cdot W_{zr}$. In the initial position, the distribution port No. 3 is communicated via the commutation channel 9 with the discharge port of the seventh pair of ports in the valve 3. In the course of movement of the chamber No. 6 to the end of the valve portion of the profile No. 4 the distributor 3 will be shifted with respect to the guide element 1 for an angle $$W_{zr} \frac{2\pi}{15W_{zr}} = \frac{16\pi}{165}$$

As the shift of a distribution port is equal that of the block 2 of variable volume chambers, the distribution port No. 3 will be shifted during the abovementioned period for a distance corresponding to a difference of their angular displacements with respect to the guide element 1, i.e. for a value $$\frac{2}{15}\pi - \frac{16}{165}\pi = \frac{2\pi}{55}$$

equal to a distance between the position of the distribution port No. 3 and the end of the discharge port of the seventh pair of ports of the valve 3. In fact, this distance is equal to $$7\theta_r - 3\theta_r = \frac{7\pi}{11} - \frac{3}{5}\pi = \frac{2\pi}{55}.$$

Thus, the transfer of the chamber No. 6 from the discharge portion of the profile No. 4 to the delivery portion of the profile No. 5 is coincident in time with the switching of this chamber from the discharge port of the seventh pair of ports to the delivery port of the eighth pair of the distribution ports.

During its further movement with respect to the guide element 1 the chamber No. 6 will pass the distance from the start to the end point of the delivery portion of the profile No. 5 for a time period $\pi/6W_{zr}$. For the same time, the valve 3 will be shifted with respect to the guide element through an angle $$W_{zr} \cdot \frac{\pi}{6W_{zr}} = 4\pi/33.$$

For the same period, the shift of the distribution port No. 3 with respect to the valve 3 will be $$\pi/6 - \frac{4\pi}{33} = \frac{\pi}{22}$$

which corresponds to the length of one port. Thus, the transfer of the chamber No. 6 from the delivery portion of the profile No. 5 to the discharge portion of the same profile is coincident in time with the period of transfer of the distribution port No. 3 from the delivery to the discharge port in the eighth pair of ports of the valve 3.

The interaction between the chamber No. 6 and other cam portions and pairs of ports, as well as the operation of other chambers for any one of commutation versions shown in FIG. 10 will follow the same manner.

The result will consist in equality between the time necessary for communication of any selected variable volume chamber 4 with each of the pairs of valve ports and the time for engagement between the closer member 5 and each of complete cam portions of the guide element 1.

The mode of movement identified previously by the conditions $W_r > W_z > W_x$ and $W_r < W_z < W_r$ corresponds to the speed ratio $$\frac{W_{rx}}{W_{zx}} > 1.$$

This case illustrates the version shown in FIGS. 7 and 9.

The case of movement corresponding to $W_z > W_r > W_x$ and $W_z < W_r < W_x$ will take place with speed ratio $$\frac{W_{rx}}{W_{zx}} > 0.$$

This case illustrates the version shown in FIGS. 6 and 10.

The mode of movement identified previously by the conditions $W_z > W_x > W_r$ and $W_z < W_x < W_r$ corresponds to the speed ratio $$\frac{W_{rc}}{W_{zr}} < 0.$$

This case illustrates the version shown in FIG. 8.

It has been assumed, when considering the interaction between members of a positive-displacement hydraulic motor for different combinations of the parameters thereof, that there is a strict time coincidence between the period for transferring each variable volume chamber from a delivery port to a discharge port of the valve 3 and the period for transferring the closer member 5 of this chamber 4 from a delivery cam portion to a discharge one, as well as the strict coincidence in time between the periods of transferring each variable volume chamber 4 from a discharge port of the valve 3 to a delivery port thereof and the periods of transferring the closer member 5 corresponding to this chamber 4 from the discharge cam portion to the delivery one. The strict coincidence in time for these periods of a cycle is ensured due to simultaneous coincidence of the contact member 5 for at least one of variable volume chambers with the start point of the cam portion of the guide element 1 as well as with the start point in a pair of ports of the valve 3, i.e. with the zero phase shift of the valve 3 with respect to the guide element 1.

As in the conventional hydraulic motor, the zero phase shift of the valve 3 corresponds (for this type of the hydraulic motor) to the maximum working volume and, hence, to the minimum (for the given flow rate of the working liquid) speed of movement for the unit 2 of the variable volume chambers with respect to the guide element 1. With the valve shift relative to the guide element other than zero, the increase of the volume of chamber 4 will partially be accompanied by its communication with the discharge line, and in the similar way, the process of decreasing the volume of said chamber 4 will partially be accompanied by its connection to the delivery line due to the fact that with the equality of time for the period of communication of any one of the variable volume chambers 4 with each pair of ports in the valve 3 and the period of engagement of closer member 5 in this chamber 4 with each of the complete cam portions of the guide element 1, the provision of one valve shift different from zero will break time coincidence between transferring of the variable volume chamber 4 from the delivery port of the valve 3 to the discharge one and transferring of the closer member 5 for this chamber 4 from the delivery cam portion to the discharge one.

The closer members 5 of the variable volume chambers 4 do not perform useful work for the length of cam portions equal to the shift of the valve 3, while variation in volume of the chamber 4 is accompanied by circulation of the working liquid through the valve channels rather than by consumption thereof from the delivery line.

In this case the working volume is less than the maximum one for the particular hydraulic motor and, therefore, the operation force is less than maximum possible with the speed of movement of the block 2 of variable volume chambers relative to the guide element 1 being in excess of the minimum one (for the predetermined flow rate of the working fluid).

To maintain the above-described mode of movement, it is necessary to keep constant the speed ratio $$\frac{W_{rc}}{W_{zr}},$$

i.e. with the shift of the valve 3 other than zero, the speed of its movement with respect to the guide element 1 should be increased.

Figure 11:
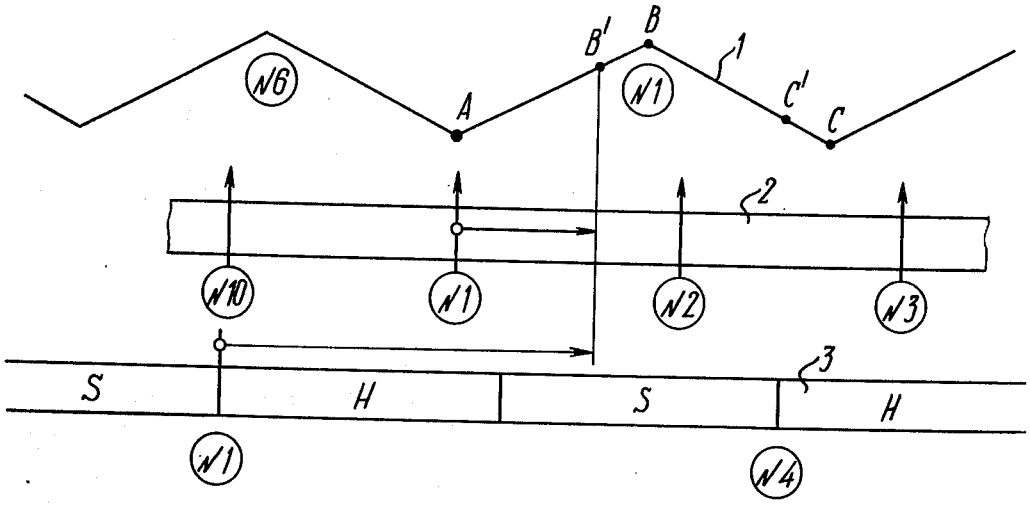
FIG. 11 is the same as shown in FIG. 6.

Referring to FIG. 11, there is shown a fragment of the development for the positive-displacement hydrallic motor similar to the embodiment which has been illustrated with reference to FIG. 7 with a shift of the valve 3. With the use of the previously described analysis one can see that the transfer of the chamber No. 1 from a delivery port of the first pair of valve ports will occur at the moment when the closer member 5 of this chamber 4 is in point B′ rather than in point B as in the case of a zero shift. The same amount of anticoincidence will take place also when transferring from a discharge port to a delivery one in point C′ instead of C. Such mode of operation is identical to that for the conventional hydraulic motor operating under controlled conditions, i.e. with the working volume less than maximum for the particular hydraulic motor. Thus, it has been established that a shift of the valve 3 in the direction of movement of the block 2 results in decrease of the working volume.

This phenomena takes place with an increase of the speed of the valve 3. The shift occuring during its acceleration leads to a decrease of the working volume and, therefore, to an increase in the speed of the block 2 of variable volume chambers with respect to the guide element 1, this new steady-state operating conditions being characterized by the relative speed of the block which is increased in proportion to an increase in the relative speed of the valve 3. The ratio of these two speeds is kept constant.

Thus, the positive-displacement hydraulic motor made in accordance with the present invention makes it possible to control the speed of the block 2 of variable volume chambers by changing the speed of the valve 3.

An attempt to arbitrary decrease the speed of the block 2 of variable volume chambers, with the speed of the valve 3 being kept constant, will lead to a shift identical to that for acceleration of the valve 3. The result will consist in decrease of the working volume of the hydraulic motor and the speed of the block 2 will grow up to a value corresponding to the speed of the valve 3.

Thus, the positive-displacement hydrallic motor according to the invention makes it possible to maintain constant relative speed of the block 2 of variable volume chambers with the constant relative speed of the valve 3.

It is possible to control the value of the working volume also by opposite shift of the valve (i.e. in the direction opposite to that of the unit). A selection of the particular embodiment should be determined with due regard to dynamic characteristics of the particular hydraulic drive unit.

What we claim is:

1. A positive-displacement hydraulic motor comprising: a guide element; a valve; a block of variable volume chambers; ports made in the surface of said valve and grouped in pairs so that one port of the pair communicates with a delivery line and the other one communicates with a discharge line; distribution ports made at the side of said unit of the variable volume chambers facing said valve; each of said chambers of said block communicated by means of a commutation channel with one of said distribution ports; a closer member accommodated in each of said chambers of the block and being in a permanent engagement with a surface of said guide element facing thereto; a surface of said guide element facing said block and divided into cam portions so that said closer member performs a complete stroke within the limits of each of said separate cam portions; said variable volume chambers of said unit and cam portions having spacings being not aliquant with respect to each other; said valve being capable to perform a positive, independent and continuous movement during the operation of the motor; said variable volume chambers of said block; said pairs of ports of the valve and said cam portions of the guide element having spacings which are selected respectively from the following relationship:

$$\frac{1}{Q_r} = \frac{n}{\theta_z} + \frac{K}{\theta_x}$$

whereby with a predetermined speed of the valve the operating conditions of the hydraulic motor can be preselected, wherein:

$\theta_r$, $\theta_z$, $\theta_x$ are spacings between pairs of ports of the valve, variable volume chambers and cam portions of the guide element respectively;

$n$ and $K$ are factors selected to provide a predetermined ratio between the speeds of the guide element, block of variable volume chambers and the valve, the factor $n$ being equal to an integer including null, and the factor $K$ being equal to any integer which is represented by a co-prime number with respect to the greatest possible number of non-coherent variable volume chambers except for null and number fulfilling the relationship:

$$K = -n\frac{\theta_x}{\theta_z}$$

wherein the factor K correlates the numbers of the variable volume chambers in order of their arrangement in the block with the numbers of the distribution ports in order of their arrangement on the surface facing the valve so that each value of numbers of one of these elements and the product of the number of another element communicating therewith through the communication channel by factor K represent modulo residues of a maximum possible number of non-coherent variable volume chambers.

2. A positive-displacement hydraulic motor according to claim 1 wherein for the case, when the block of the variable volume chambers, guide element and valve are moved respectively with speeds $W_z$, $W_x$, $W_r$ having the relationships $W_x > W_z > W_r$ and $W_x < W_z < W_r$, the factors n and K are selected from the following condition:

$$n\frac{\theta_x}{\theta_z} + K < 0 \quad .$$

3. A positive-displacement hydraulic motor according to claim 1 wherein for the case, when the block of the variable volume chambers, guide element and valve are moved respectively with speeds having the relationships $W_x \geqslant W_r > W_z$ and $W_x \leqslant W_r < W_z$, the factors $n$ and $K$ are selected from the following condition:

$$n\frac{\theta_x}{\theta_z} + K \geqslant 1 \quad .$$

4. A positive displacement hydraulic motor according to claim 1 wherein for the case, when the block of the variable volume chambers, guide element and valve are moved respectively with speeds having the relationships $W_r \geqslant W_x > W_z$ and $W_r \leqslant W_x < W_z$, the factors $n$ and $K$ are selected from the following condition:

$$1 \geqslant n\frac{\theta_x}{\theta_z} + K > 0 \quad .$$

* * * * *